United States Patent [19]

Taylor

[11] 4,436,401

[45] Mar. 13, 1984

[54] TANK WITH LIGHT-TIGHT CLOSURE

[75] Inventor: Eric Taylor, London, England

[73] Assignee: Paterson Products Limited, London, England

[21] Appl. No.: 363,583

[22] Filed: Mar. 30, 1982

[30] Foreign Application Priority Data

Apr. 7, 1981 [GB] United Kingdom ..... 8110891

[51] Int. Cl.[3] ..... G03D 13/04

[52] U.S. Cl. ..... 354/312; 354/331; 220/293

[58] Field of Search ..... 354/312, 313, 314, 316, 354/331, 335, 337; 220/293, 298, 302

[56] References Cited

U.S. PATENT DOCUMENTS

| | | | |
|---|---|---|---|
| 2,112,605 | 3/1938 | Pless | 354/313 |
| 2,467,084 | 4/1949 | Konchan | 220/302 |
| 2,656,773 | 10/1953 | Wiebalck | 354/310 |
| 4,065,020 | 12/1977 | Carson | 220/293 |
| 4,211,481 | 7/1980 | Bernhardt | 354/313 |

*Primary Examiner*—A. A. Mathews

*Attorney, Agent, or Firm*—Darby & Darby

[57] ABSTRACT

Photographic developing tanks are described of improved and simplified construction. In particular, the tank has a cylindrical base, the top of which can be closed off in light-tight fashion by a wide funnel member extending right across it. The funnel member fits into the base by a modified latching bayonet fitting constituted by cooperating formations on the inside of the walls of the base member near their top and on the outside of the funnel member.

4 Claims, 4 Drawing Figures

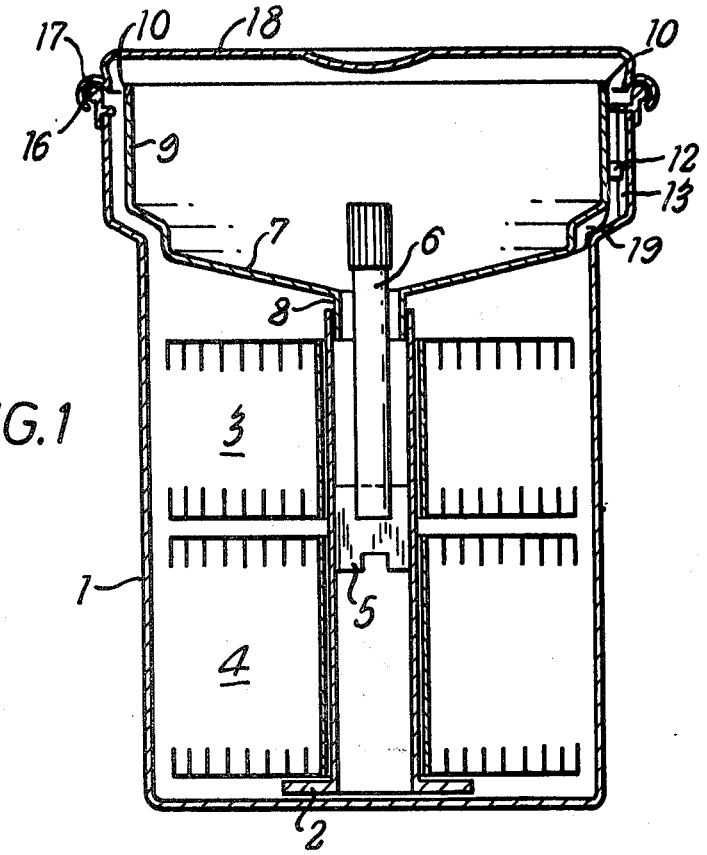
FIG.1
FIG.2
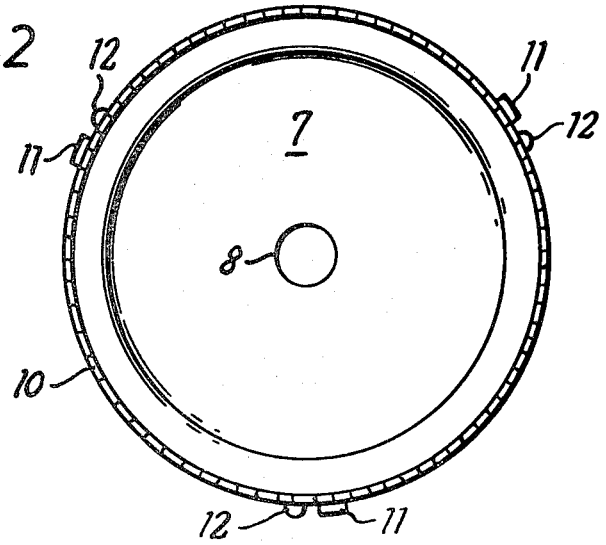

TANK WITH LIGHT-TIGHT CLOSURE

This invention relates to photographic developing tanks.

For many years, apparatus has been known for processing lengths of exposed photographic film using processing solutions consisting of a light-tight tank in which the film is supported on a film-holder, the film being formed into a spiral coil. The film-holder generally consists of a central member on which are mounted a pair of spaced discs, the facing surfaces of the discs being provided with opposite handed spiral grooves in which the edges of the film strip lie during processing. Such apparatus is widely used for amateur and professional photographers for developing of exposed film and numerous specific designs of developing tank have appeared on the market.

A disadvantage of many previous designs has been that they have been made of a number of intricately moulded sections, which is not only expensive but also leads to disavantages in use. In particular, the engagement of a lid with a base portion has conventionally been effected by means of a suitable screw thread, often a four-throw thread, which is difficult to mould and has the disadvantage of tending to retain small quantities of processing solution requiring great care to be exercised during rinsing to ensure that all traces of solution are removed, since remnant traces can lead to blemishes on the film during handling.

We have now found that developing tanks of the type generally known may be substantially improved by providing for their closure by a wide funnel member and an overall cap member, the wide funnel member being securable to close an upwardly open tank base in light-tight fashion by means of a modified type of bayonet fitting.

Thus according to the present invention there is provided a developing tank comprising a base member having the form of a hollow, generally cylindrial upwardly open tank, a film strip receiving member adapted to fit inside the tank and comprising a central spindle and a film-supported mounted thereon, the film-support including a pair of spaced apart discs having on their facing surfaces spiral grooves for the reception of a film-strip, the tank additionally including a generally funnel-shaped closure member adapted to close the upwardly open tank base in light-tight fashion, wherein the funnel extends across the entire width of the tank and has on its external periphery means which constitute, together with cooperating means on the interior cylindrical surface of the walls of the tank, a bayonet fitting, the funnel and tank base having cooperating resilient means enabling the funnel to be latched into a position in which the funnel cannot be axially extracted from the base.

Preferably the tank comprises a further component in the form of an overall lid adapted to engage the upper periphery of the base member and seal therewith. Most conveniently the lid is of stiff but compliant material shaped to snap-fit over a bead formed on the upper edge of the base member.

The cooperating means on the exterior of the funnel and interior of the upper walls of the base member preferably comprise one or more beads on the interior of the tank base and one or more bead/stop formations located on the exterior of the funnel. Cnveniently three such formations are provided equi-angularly spaced about the central axis of the tank.

The cooperating means may be formed integral with the plastics mouldings constituting the base member and funnel member of the tank and by suitable dimensioning the resilience of those members may be sufficient to enable the appropriate latching to take place.

The invention is illustrated by way of example with reference to the accompanying drawings which show:

FIG. 1 is a diagrammatic sectional view through a developing tank according to the present invention;

FIG. 2 is a plan view of the funnel member from above;

Figure 3:
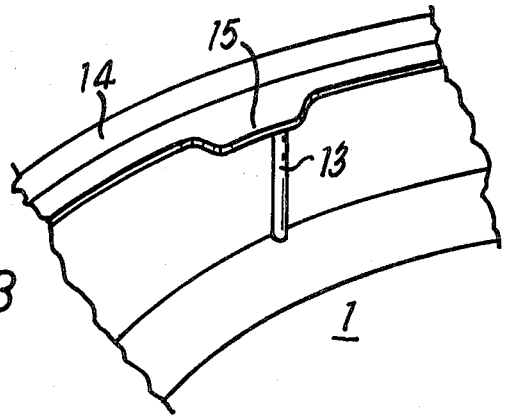
FIG. 3 is a perspective view on an enlarged scale of part of the inner upper walls of the base member.

Referring to the drawings, the developing tank has a base 1, which is in the form of a hollow cylinder upwardly open and closed downwardly by a floor. On the floor rests a central spindle 2 which supports on its exterior two film-holder units 3 and 4. Taller tanks could support more such units. The centre of spindle 2 is hollow but bridged by a bridging plate 5. A turning handle 6 having the form of a short hollow tube with its upper end knurled and its lower end slotted for fitting over plate 5 may be inserted part way into spindle 2 to enable the whole assembly of spindle 2 and film-holders 3 and 4 to be rotated axially.

In use, light may be prevented from reaching the interior of the developing tank by means of a funnel member 7, which consists of a wide semi-angle frusto-conical portion having a short down pipe 8 which projects downwardly into the upper end of hollow spindle 2, as seen in FIG. 1, and has an upwardly extending generally cylindrical wall 9. The zig-zag section gap between funnel 9 and the wall of base member 1 serves to prevent light entering between the two. The upper edge of wall section 9 is toothed at 10 to enable it to be gripped for turning as described below.

Finally, the upper circular edge of the base member 1 is provided with a moulding having an upward, outwardly directed rim 16 which may be engaged by a resilient complementary shaped groove 17 forming part of an overall seal cap 18 e.g. made of resilient plastics such as polypropylene and sized to be a snap-fit over rim 16.

The location of the funnel member 7 in the base member 1 is ensured by three equi-angularly spaced spacers 19 integrally moulded with member 7 which rest on the narrow annular frusto-conical section of the base member 1. This acts to leave a zig-zag path which, while it is still light-trapping, enables processing solutions to be poured rapidly and easily from the interior of the tank.

Figure 4:
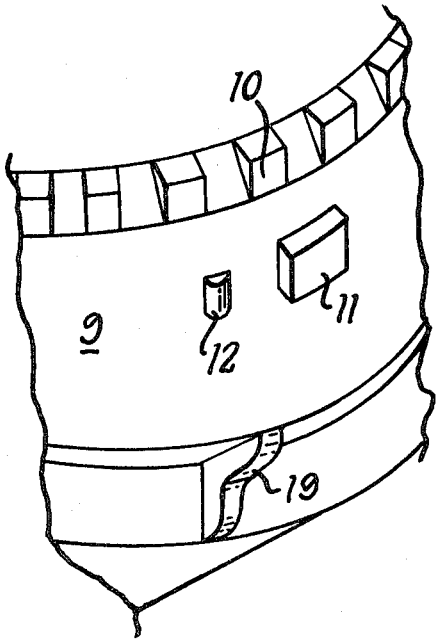
FIG. 4 a partial perspective view, likewise on an enlarged scale, of the corresponding exterior portion of the funnel member.

As shown in detail in FIGS. 3 and 4, the interior of the base bears three beads 13 and the exterior of the funnel 7 three beads 12. These and the base 1 and funnel 7 are so dimensioned that the circle joining the apices of beads 12 is slightly larger than that joining the apices of beads 13. However, because of the resiliency of the material from which members 1 and 7 are made, if the funnel 7 is inserted into the base 1 and turned clockwise, beads 12 and 13 ride over one another to latch the funnel 7 in place, with bead 13 located in the space between bead 12 and a stop 11. In this position, axial removal of funnel 7 is prevented by formations 15 on ring 14.

In order to remove the funnel it is simply turned anti-clockwise to spring beads 12 and 13 past one another and take bead 12 and stop 11 out from under formation 15. Turning the funnel either way is facilitated by the toothing 10.

I claim:

1. In a developing tank comprising a base member having the form of a hollow, generally cylindrical upwardly open tank, a film strip receiving member adapted to fit inside the tank and comprising a central spindle and a film-support mounted thereon, the film-support including a pair of spaced apart discs having on their facing surfaces spiral grooves for the reception of a film-strip, the tank additionally including a closure member adapted to close the upwardly open tank base in light-tight fashion, the improvement comprising a substantially funnel shaped closure member which extends across the entire width of the tank and has on its external periphery means which constitute, together with cooperating means on the interior cylindrical surface of the walls of the tank, a bayonet fitting comprising at least one bead on the interior of the tank base and at least one bead and stop formation located on the exterior of the closure member to enable the closure member to be latched into a position in which it cannot be axially extracted from the base.

2. The developing tank of claim 1 and additionally comprising a lid adapted to engage the upper periphery of the base member and seal therewith.

3. The developing tank of claim 2 wherein the upper edge of the base member has a rim formed thereon and the lid is a snap fit sealingly over the rim.

4. The developing tank of claim 1 wherein the base and closure member bear three cooperating means equiangularly spaced about the central axis of the tank.

* * * * *